US007178241B1

(12) United States Patent
Cummings et al.

(10) Patent No.: US 7,178,241 B1
(45) Date of Patent: Feb. 20, 2007

(54) LUBRICATING SHAVING ASSEMBLY

(75) Inventors: Michael J. Cummings, Cheshire, CT (US); Andrew J. Pennella, Stamford, CT (US); Paul R. Dansreau, Shelton, CT (US); Michael J. Sasuta, Milford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 09/576,269

(22) Filed: May 22, 2000

(51) Int. Cl.
*B26B 21/14* (2006.01)
*B26B 21/44* (2006.01)

(52) U.S. Cl. ..... 30/41; 30/41.5; 30/50; 30/58; 30/535

(58) Field of Classification Search ..... 30/41, 30/125, 535, 538, 41.5, 41.6, 38, 39, 50, 30/57, 58, 74.1, 84, 123.3; 222/191; 401/195
See application file for complete search history.

(56) References Cited

U.S. PATENT DOCUMENTS

| | | | | | |
|---|---|---|---|---|---|
| 330,418 | A | | 11/1885 | Partridge et al. | |
| 951,036 | A | | 3/1910 | Waterman | |
| 1,342,028 | A | | 6/1920 | Nordskog | |
| 1,551,388 | A | * | 8/1925 | Gross | 30/41 |
| 1,744,280 | A | | 1/1930 | Peterson | |
| 1,768,307 | A | | 6/1930 | Bleloch et al. | |
| 1,836,800 | A | * | 12/1931 | Hope | 30/41 |
| 1,852,708 | A | * | 4/1932 | Stuart | 30/41 |
| 1,890,334 | A | * | 12/1932 | Muros | 30/50 |
| 1,892,836 | A | * | 1/1933 | Harvey | 30/41 |
| 1,991,405 | A | * | 2/1935 | Merriman | 30/41 |
| 2,037,588 | A | * | 4/1936 | Pica | 30/41 |
| 2,085,446 | A | * | 6/1937 | Philippe | 222/386 |
| 2,131,498 | A | * | 9/1938 | Chandler | 30/41 |
| 2,183,554 | A | | 12/1939 | Evans | 30/84 |
| 2,315,785 | A | * | 4/1943 | Greenleaf | 30/50 |
| 2,392,975 | A | * | 1/1946 | Cooney | 30/41 |

(Continued)

FOREIGN PATENT DOCUMENTS

BE 509715 3/1952

(Continued)

OTHER PUBLICATIONS

PCT Search Report for Serial No. PCT/IB03/01144 dated Oct. 29, 2003.

*Primary Examiner*—Clark F. Dexter
(74) *Attorney, Agent, or Firm*—Michaud-Duffy Group LLP

(57) ABSTRACT

A shaving assembly includes a grippable body having an upper end, a lower end, and one or more side walls extending therebetween. The body includes a storage reservoir for holding a fluid shaving preparation. The storage reservoir is enclosed by the upper and lower ends and the one or more side walls of the body. The upper end of the body has a razor cartridge receiving area for having one or more razor cartridges attached thereto. The upper end of the body also has a plurality of openings adjacent the razor cartridge receiving area and in communication with the storage reservoir. A pedestal is disposed within the storage reservoir. The pedestal is selectively movable between the lower and upper ends of the body for urging the fluid shaving preparation through the plurality of openings at the upper end of the body to dispense the shaving preparation around the razor cartridges.

14 Claims, 14 Drawing Sheets

U.S. PATENT DOCUMENTS

| | | | | | |
|---|---|---|---|---|---|
| 2,455,152 | A | * | 11/1948 | Wolpert | 30/41 |
| 2,691,217 | A | * | 10/1954 | Clark | 30/50 |
| 2,839,224 | A | * | 6/1958 | Lipka | 222/191 |
| 2,866,265 | A | * | 12/1958 | Kells | 30/41 |
| 2,917,765 | A | * | 12/1959 | Jakubowski | 401/175 |
| 3,378,922 | A | | 4/1968 | Schrader et al. | 30/66 |
| 3,488,764 | A | * | 1/1970 | Welsh | 30/50 |
| 3,593,416 | A | * | 7/1971 | Edson | 30/50 |
| 3,675,323 | A | | 7/1972 | Braginetz | 30/32 |
| 3,703,764 | A | | 11/1972 | Perry | 30/32 |
| 3,724,070 | A | | 4/1973 | Dorion, Jr. | 30/47 |
| 3,786,563 | A | | 1/1974 | Dorion, Jr. et al | 30/50 |
| 3,832,774 | A | | 9/1974 | Perry | 30/32 |
| 3,895,437 | A | | 7/1975 | DiBuono | 30/337 |
| 3,934,338 | A | | 1/1976 | Braginetz | 30/47 |
| 4,074,429 | A | | 2/1978 | Roberts | 30/41 |
| 4,314,404 | A | | 2/1982 | Ruiz et al. | 30/41 |
| 4,336,651 | A | | 6/1982 | Caro | 30/49 |
| 4,389,773 | A | | 6/1983 | Nissen et al. | 30/50 |
| 4,407,067 | A | | 10/1983 | Trotta | 30/50 |
| 4,442,598 | A | | 4/1984 | Jacobson | 30/47 |
| 4,443,940 | A | | 4/1984 | Francis et al. | 30/50 |
| 4,483,068 | A | | 11/1984 | Clifford | 30/49 |
| 4,501,066 | A | * | 2/1985 | Sceberras | 30/50 |
| 4,534,110 | A | | 8/1985 | Glass | 34/346.57 |
| 4,535,537 | A | | 8/1985 | Ferraro et al. | 30/32 |
| 4,562,644 | A | | 1/1986 | Hitchens | 30/41 |
| 4,573,266 | A | | 3/1986 | Jacobson | 30/41 |
| 4,586,255 | A | | 5/1986 | Jacobson | 30/41 |
| 4,587,729 | A | | 5/1986 | Jacobson | |
| 4,595,124 | A | * | 6/1986 | Duval et al. | 222/39 |
| 4,621,424 | A | | 11/1986 | Jacobson | 30/41 |
| 4,624,051 | A | | 11/1986 | Apprille, Jr. et al. | 30/50 |
| 4,653,188 | A | * | 3/1987 | Kwak | 30/41 |
| 4,709,476 | A | | 12/1987 | Shurtleff et al. | |
| 4,712,300 | A | | 12/1987 | Hemmeter | 30/41 |
| D298,068 | S | | 10/1988 | Gilder | D28/47 |
| 4,778,640 | A | | 10/1988 | Braun et al. | |
| 4,807,360 | A | | 2/1989 | Cerier et al. | 30/49 |
| 4,809,432 | A | * | 3/1989 | Schauble | 30/41 |
| 4,850,106 | A | | 7/1989 | Braun et al. | |
| 4,875,288 | A | | 10/1989 | Trotta et al. | 30/49 |
| 4,901,437 | A | | 2/1990 | Iten | |
| 4,944,090 | A | | 7/1990 | Sumnall | 30/41 |
| 4,970,784 | A | | 11/1990 | Althaus et al. | 30/89 |
| 5,005,287 | A | | 4/1991 | Ritter | 30/41 |
| 5,056,222 | A | | 10/1991 | Miller et al. | |
| 5,063,667 | A | | 11/1991 | Jacobson | |
| 5,063,669 | A | | 11/1991 | Althaus | 30/77 |
| 5,079,839 | A | | 1/1992 | Conrad, Jr. et al. | |
| 5,084,968 | A | | 2/1992 | Trotta | 30/47 |
| 5,121,541 | A | | 6/1992 | Patrakis | 30/41 |
| 5,134,775 | A | | 8/1992 | Althaus et al. | 30/41 |
| 5,141,349 | A | | 8/1992 | Maguire, Jr. et al. | 30/41 X |
| 5,161,307 | A | | 11/1992 | Althaus | 30/77 |
| 5,191,712 | A | | 3/1993 | Crook et al. | 30/34.2 |
| 5,241,751 | A | * | 9/1993 | Goh | 30/41 X |
| 5,249,361 | A | | 10/1993 | Apprille, Jr. et al. | 30/77 |
| 5,265,759 | A | | 11/1993 | Coffin | 221/123 |
| 5,287,624 | A | * | 2/1994 | Mondo et al. | 30/41 |
| 5,319,852 | A | | 6/1994 | Metzger | 30/41 X |
| 5,347,714 | A | | 9/1994 | Prochaska | |
| 5,369,885 | A | | 12/1994 | Ferraro | 30/41 |
| 5,430,939 | A | | 7/1995 | Johnston | 30/41 |
| 5,463,813 | A | | 11/1995 | Otsuka et al. | 30/43.9 |
| 5,493,778 | A | | 2/1996 | Ichiyanagi | 30/41 |
| 5,497,550 | A | | 3/1996 | Trotta et al. | 30/50 |
| 5,517,760 | A | | 5/1996 | Prochaska | |
| D373,218 | S | | 8/1996 | Shurtleff et al. | D28/44 |
| 5,666,729 | A | | 9/1997 | Ferraro | 30/50 |
| D403,811 | S | | 1/1999 | Brown et al. | D28/47 |
| 5,903,979 | A | | 5/1999 | Oldroyd | |
| 5,953,825 | A | | 9/1999 | Christman et al. | 30/257 |
| 5,956,849 | A | | 9/1999 | Chadwick et al. | |
| D415,315 | S | | 10/1999 | Swanson et al. | D28/47 |
| 5,983,500 | A | | 11/1999 | da Silva | |
| 6,149,981 | A | | 11/2000 | Chadwick et al. | |
| 6,161,287 | A | | 12/2000 | Swanson et al. | |
| 6,185,823 | B1 | | 2/2001 | Brown et al. | |
| 6,295,734 | B1 | | 10/2001 | Gilder et al. | 30/50 |
| 6,298,557 | B1 | | 10/2001 | Gilder et al. | 30/34.2 |
| 6,298,558 | B1 | | 10/2001 | Tseng et al. | 30/41 |
| 6,308,416 | B1 | | 10/2001 | Bosy et al. | 30/50 |
| 6,430,818 | B1 | | 8/2002 | Wonderley | |
| 6,502,318 | B1 | | 1/2003 | Gilder | 30/530 |
| 6,584,690 | B2 | | 7/2003 | Orloff et al. | |
| 6,594,904 | B1 | | 7/2003 | Tseng | |
| 2002/0023351 | A1 | * | 2/2002 | Simms | 30/41 |

FOREIGN PATENT DOCUMENTS

| | | |
|---|---|---|
| DE | 319832 | 2/1919 |
| DE | G 87 17 729.3 | 10/1989 |
| EP | 0 477 132 B1 | 3/1992 |
| EP | 0 453 906 B1 | 12/1994 |
| EP | 1 125 697 A1 | 8/2001 |
| FR | 482 302 | 3/1917 |
| FR | 806 899 | 12/1936 |
| FR | 1484360 | 6/1967 |
| FR | 1 503 887 | 12/1967 |
| GB | 409 902 | 5/1934 |
| GB | 1 432 182 | 4/1976 |
| GB | 1 572 442 | 7/1980 |
| GB | 2 042 959 A | 10/1980 |
| GB | 2116470 | 9/1983 |
| JP | 4-361783 | 12/1992 |
| JP | 10-165668 | 6/1998 |
| WO | WO 91/01204 | 2/1991 |
| WO | WO 96/02369 | 2/1996 |
| WO | 98/36878 | 8/1998 |

* cited by examiner

LUBRICATING SHAVING ASSEMBLY

FIELD OF THE INVENTION

The present invention is directed to a shaving assembly and is particularly directed to a wet shaving assembly capable of simultaneously lubricating and shaving a shaving surface in a single stroke.

BACKGROUND OF THE INVENTION

Shaving body hair typically requires at least five distinct steps: (1) wetting a skin surface, (2) preparing and/or dispensing a skin preparation (e.g., shaving cream), (3) applying the skin preparation to the shaving surface, (4) shaving the skin surface with a blade, and (5) washing away excess shaving preparation remaining on the skin surface. The above-mentioned steps are relatively complex and require a significant amount of time.

There have been a wide variety of efforts directed to combining two or more of the above-listed steps. For example, U.S. Pat. No. 4,712,300 discloses a razor blade capable of moisturizing and shaving the skin in a single step. The razor blade holder includes a block of sponge-like material having a razor blade assembly implanted therein, with the cutting edges of the blades arranged at or slightly below the surface of the sponge-like block. When wet, the sponge-like block may be pressed lightly on the skin surface and moved in a direction for shaving the skin.

U.S. Pat. No. 4,074,429 discloses a combined assembly for applying lather and moisture to a shaving surface in advance of a razor blade so that the shaving operation can be conducted in a single stroke. This is accomplished by attaching a lathering device, such as a soap cake, immediately in front of the blade of a razor. During a shaving operation, the razor and lathering device are immersed in water and the razor is drawn across a user's skin in an ordinary manner. The position of the lathering device on the razor is such that the soap cake contacts the user's face immediately in advance of the razor blade and thus provides a lubrication immediately before shaving. However, the use of the lather-applying assembly requires constant adjustment of the soap cake so that the lubricating substance is properly applied to the shaving surface.

U.S. Pat. No. 4,562,644 discloses a lubricant-applying safety razor including a lubricating member provided in front of a cutting edge of a blade. The lubricating member is an elongated cylindrical roll formed of lubricating compounds and extending substantially across the width of the cutting blade. When the razor is moved along a user's skin in a shaving motion, the lubricating member engages the skin of the user to apply a lubricating film to the skin.

U.S. Pat. No. 3,895,437 discloses a shaving assembly including a sponge-like element secured to a razor in a position that immediately precedes the advance of the blade. The sponge-like element is maintained in a saturated condition so that upon contacting shaving preparation applied to a user's face, the shaving preparation is moisturized by the sponge.

U.S. Pat. No. 4,944,090 discloses a razor including a soluble body carried by a razor cartridge. The soluble body is movable relative to the razor cartridge and is biased through an opening in the razor cartridge by a spring. The soluble body does not completely surround the razor. As a result, the razor may lubricate the skin in only one axial direction.

U.S. Pat. No. 5,141,349 discloses an apparatus for lubricating the blade of a razor by applying a liquid lubricant and solubilizer mixture via an aerosol system. The lubricant is applied directly to the razor blade immediately prior to shaving so that shaving can be performed without first applying a shaving preparation directly to the area to be shaved.

U.S. Pat. No. 5,121,541 discloses an electric razor which houses a misting mechanism for misting a lubricating agent, such as water, cologne or beard softener onto a user's skin while shaving. The misting mechanism includes a mist conduit, misting container and an ultrasonic vibrator. The ultrasonic vibrator is activated by the same power source as the electric razor. A protective screen overlies the mist conduit to prevent whiskers from contaminating the misting mechanism.

To some extent, the above-mentioned patents have simplified and/or improved the shaving process. However, the shaving devices disclosed in these patents are incapable of operating effectively in certain unique shaving environments, such as when a user attempts to shave while taking a shower. In addition, the shaving devices are able to lubricate and shave in only one direction.

There are a number of unique problems associated with shaving in a shower. First, the shaving preparation, such as shaving cream, is frequently washed away from the shaving surface before the razor touches the skin. As a result, there is typically little or no lubricant covering the skin or shaving surface during shaving. This makes it difficult, if not impossible, to take advantage of the lubricating properties of a shaving preparation and generally results in an uncomfortable shaving experience. Moreover, individuals who shave while in a shower must often assume awkward and unsafe positions in order to prevent water from washing away the shaving preparation. In addition, shaving in the shower is a rather complex process that requires a shaver to 1) place the razor in a stable location within the shower; 2) apply a shaving preparation to a skin surface; and 3) re-grasp the razor for shaving the skin. The chance that a user will drop the razor during this complex process in significant. In addition, the user must insure that the blade is drawn in only one direction over the skin surface to avoid nicks and cuts.

In response to the problems associated with shaving in a shower, commonly assigned U.S. patent application Ser. No. 09/505,408, filed Feb. 16, 2000, entitled "Wet Shaving Assembly," discloses a shaving assembly for simultaneously applying a shaving preparation and removing hair in a single step. The shaving assembly includes a base having an upper end, a lower end and a hollow space between the upper and lower ends, whereby the hollow space defines an opening at the upper end of the base. The shaving assembly also includes a receiver for a razor, such as a cartridge receiver for a razor blade cartridge, that is connected with the base and that is disposed at the opening at the upper end of the base. The cartridge receiver has a perimeter and the opening at the upper end of the base completely surrounds the perimeter of the cartridge receiver. The hollow space of the base is adapted for containing a substantially solid shaving preparation, such as a soap cake, or a body wash and may be combined with skin beneficial ingredients and/or scent.

Thus, there is a need for a shaving assembly that allows for efficient and safe shaving in a wet environment, such as a shower. There is also a need for a shaving assembly that incorporates a fluid shaving preparation with a razor in such a way as to maximize skin lubrication during hair removal. Such a wet razor system should also allow for simultaneous application of a shaving preparation and hair removal, thereby reducing the amount of time spent in the shower.

SUMMARY OF THE INVENTION

In accordance with certain preferred embodiments of the present invention, a lubricating shaving assembly includes a body that may be grasped by a human hand. The body is preferably made of a polymer material such as plastic, a metal, or a combination of a polymer and metal. The body preferably has an upper end, a lower end, and one or more side walls extending between the upper and lower ends. The upper end of the body preferably includes a razor cartridge receiving area that is adapted for having one or more razor cartridges attached thereto. The one or more razor cartridges may be pivotally attached to the razor cartridge receiving area. The one or more razor cartridges may also be flexibly attached to the razor cartridge receiving area so that the razor cartridges may simultaneously pivot, swivel or move torsionally relative to the cartridge receiving area. In certain preferred embodiments, the shaving assembly includes a dispenser portion that stores the shaving preparation and a detachable cap that secures the one or more razor cartridges. The cap may be removed from the dispenser portion so that either the cap or the dispenser portion may be disposed of and replaced with a new cap and/or dispenser.

The body preferably includes a storage reservoir that is adapted for holding and dispensing a fluid shaving preparation such as a gel, semi-solid material such as a gel, cream, oil, foam or lotion. Before the shaving assembly is operated, a mass of fluid shaving preparation is deposited in the reservoir. The mass of shaving preparation may be deposited within the reservoir during the initial manufacture of the assembly, or the reservoir may be refilled with a refill purchased by a retail consumer. The storage reservoir is desirably substantially enclosed by the upper and lower ends of the body, as well as by the one or more side walls of the body. The upper end of the body may also have a plurality of openings adjacent the razor cartridge receiving area. The plurality of openings may surround the razor cartridge receiving area and may also be provided within the razor cartridge receiving area. The plurality of openings are preferably in communication with the storage reservoir.

The body also preferably includes a selectively movable pedestal having a top surface and a bottom surface. The top surface of the pedestal may be substantially flat. The pedestal is desirably disposed within the storage reservoir of the body and has an outer perimeter that closely engages the interior surface of the sidewalls extending between the upper and lower ends of the assembly. The pedestal is preferably selectively movable between the lower and upper ends of the body for dispensing the fluid shaving preparation stored in the reservoir through the plurality of openings at the upper end of the body.

In certain preferred embodiments, the upper end of the body or cap may include one or more retaining tabs that are attachable to the upper end of the body for securing one or more razor cartridges within the razor cartridge receiving area. The one or more retaining tabs may be permanently attached to the upper end of the body, such as by being hingedly attached to the upper end of the body by flexible hinges. The retaining tabs preferably engage one or more ends of the razor cartridges for securing the razor cartridges within the cartridge receiving area. The secured razor cartridges are preferably capable of pivoting, swiveling, and/or moving torsionally within the razor cartridge receiving area.

Each razor cartridge preferably includes one or more cutting blades having a longitudinal axis. The longitudinal axis of each razor cartridge preferably extends in a direction that is substantially parallel to the longitudinal axes of the cutting blades attached thereto. In certain embodiments, two razor cartridges are attached to the razor cartridge receiving area of the body so that the one or more cutting blades of the two razor cartridges face one another. The razor cartridges may also include one or more wires, molded elements, or die cut elements that extend in directions substantially transverse to the longitudinal axis of the one or more cutting blades. The one or more wires, molded elements or die cut elements preferably overlie the one or more cutting blades. Each razor cartridge may also include a mesh overlying the one or more cutting blades of the razor cartridge. In yet other preferred embodiments, the razor cartridge may include one or more razor blades in the form of a metal foil having a number of holes therein, whereby each hole has a peripheral portion having one or more cutting edges. Such razor cartridges are disclosed in commonly assigned U.S. Pat. No. 4,438,068, the disclosure of which is hereby incorporated by reference herein.

As mentioned above, the movable pedestal preferably includes an outer perimeter that closely engages the interior side walls of the body so as to form a fluid-tight seal therebetween. As the pedestal moves in an upward direction, the mass of fluid shaving preparation is forced toward the plurality of openings at the upper end of the body. Thus, the upwardly moving pedestal urges and/or forces the shaving preparation through the plurality of holes. Because the plurality of holes are adjacent the razor cartridge receiving area, the shaving preparation will be dispensed around the one or more razor cartridges attached to the body.

A broad array of elements may be used for moving the pedestal toward the upper end of the body. A ratcheting mechanism may be connected to the body and the pedestal for selectively moving the pedestal. At least a portion of the ratcheting mechanism is preferably accessible at the exterior surface of the body. The ratcheting mechanism may extend through an opening in the one or more side walls of the body. The ratcheting mechanism may also include a rotatable knob, a lever or a depressible button. The ratcheting element preferably makes a clicking sound or produces a vibration so that a user can sense that an incremental advancement of the pedestal has occurred. In certain embodiments, lower end of the pedestal may also include an opening extending therethrough having internal threads that are adapted for receiving at least a portion of the adjustable element. The adjustable element may include a rotatable shaft having a first end in contact with the pedestal and a second end that extends through the opening at the lower end of the body. The shaft may have external threads extending between the first and second ends thereof for engaging the internal threads of the opening of the pedestal. A knob may be attached to the lower end of the shaft. The knob may be rotated which, in turn, rotates the shaft. As the shaft rotates, the external threads of the shaft engage the internal threads of the opening of the pedestal for moving the pedestal toward the upper end of the body.

In certain preferred embodiments, one or more parts of the shaving assembly may be disassembled and/or detached from one another so that one of the parts may be replaced. In one preferred embodiment, one or more worn or dull razor cartridges may be detached from the assembly and replaced with new razor cartridges. In other embodiments, the upper end of the body or cap may be detached from the lower end or dispenser portion of the shaving assembly. The cap may have one or more razor cartridges permanently secured thereto. In this embodiment, the cap may be selectively detached from the lower body and replaced with a replacement cap having fresh razor cartridges secured thereto. The lower end of dispenser portion of the shaving assembly may also be replaced when the reservoir for the shaving preparation is emptied.

In still other preferred embodiments, a shaving assembly preferably comprises a handle having an upper end, a lower end and a substantially enclosed storage reservoir between the upper and lowers ends, the storage reservoir being adapted for holding a fluid shaving preparation. The upper end of the handle desirably has a razor cartridge receiving area adapted for having one or more razor cartridges attached thereto. The upper end of the handle preferably includes a plurality of openings adjacent the razor cartridge receiving area and in communication with the storage reservoir. A pedestal is preferably disposed within the storage reservoir. The pedestal is preferably movable toward the upper end of the handle for urging the fluid shaving preparation through the plurality of openings. The shaving assembly may also include one or more razor cartridges attached to the razor cartridge receiving area at the upper end of the handle. As the pedestal moves toward the upper end of the handle, the shaving preparation urged through the plurality of holes is dispensed about and adjacent the one or more razor cartridges. The movable pedestal may be connected to the handle by a ratcheting mechanism accessible at an exterior surface of the handle. The ratcheting mechanism may be actuated for moving the pedestal toward the upper end of the handle for dispensing shaving preparation. In other embodiments, an adjustable element including a knob may be in contact with the handle and the movable pedestal for selectively moving the pedestal toward the upper end of the handle. The adjustable element may include a rotatable shaft having a first end in contact with the pedestal and a second end that extends toward the lower end of said handle. The rotatable knob may be secured to the lower end of the shaft, whereby the knob may be rotated for moving the pedestal toward the upper end of the handle so as to dispense a portion of the fluid shaving preparation.

DETAILED DESCRIPTION OF PREFERRED EMBODIMENTS

Figure 1:
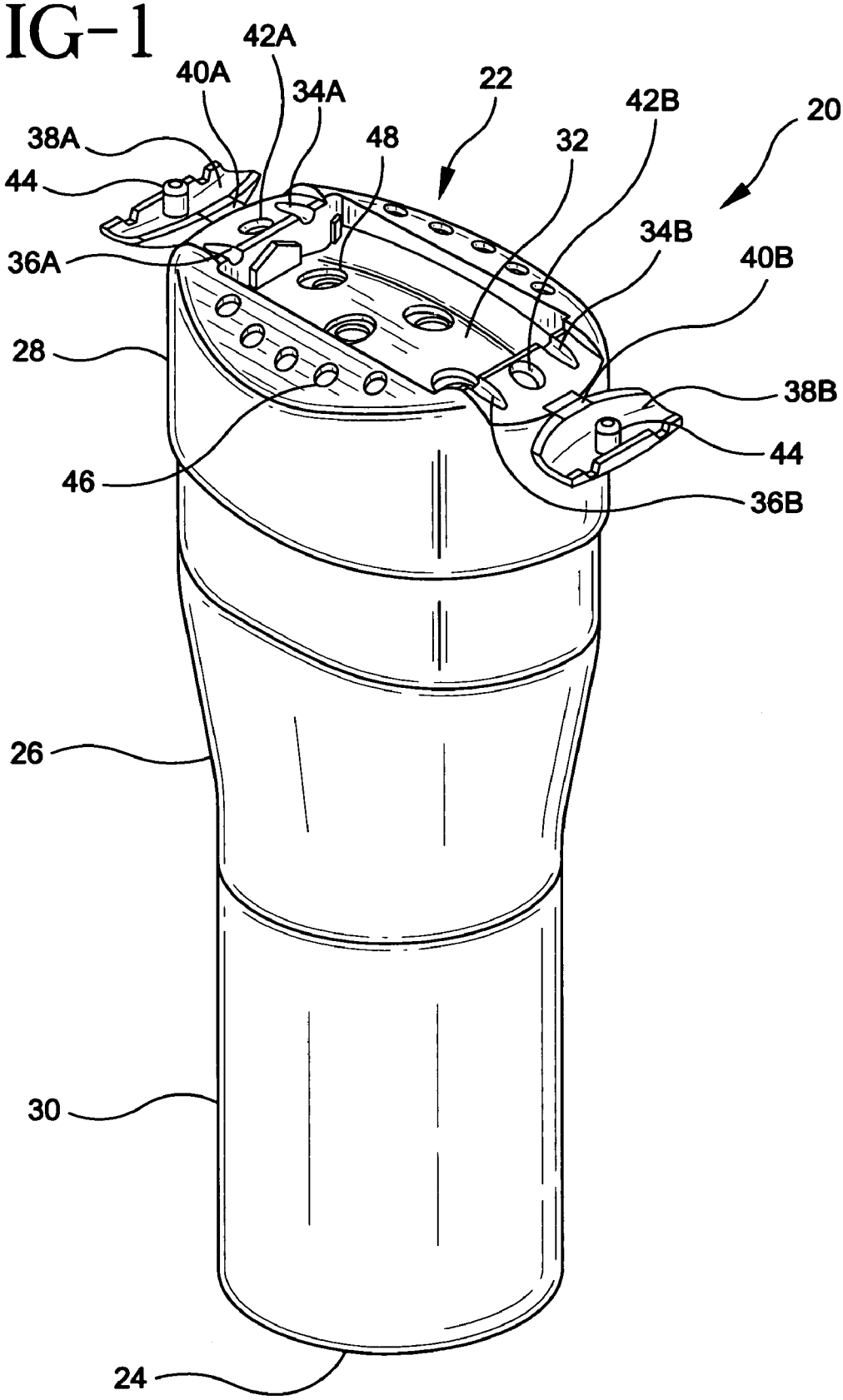
FIG. 1 shows a perspective view of a lubricating shaving assembly including an upper end or cap and a lower end or dispenser portion, in accordance with certain preferred embodiments of the present invention.

FIG. 1 shows a perspective view of a lubricating shaving assembly in accordance with certain preferred embodiments of the present invention. The lubricating shaving assembly 20 includes a dispensing portion 30 formed as a grippable body or handle having an upper end 22, a lower end 24 and one or more sidewalls 26 extending between the upper and lower ends. In the particular embodiment shown in FIG. 1, the upper end of the assembly comprises a cap or cover 28 that is releasably attached to the lower end or dispensing portion 30 of the assembly. The cap 28 preferably includes a razor cartridge receiving area 32 that is adapted for receiving one or more razor cartridges (not shown). The razor cartridge receiving area 32 is preferably a depression formed in a top face of the cap 28. The razor cartridge receiving area includes a first set of slots 34A, 34B that are sized for receiving the ends of a razor cartridge (not shown). The razor cartridge receiving area also includes a second set of slots 36A, 36B that are sized for receiving the ends of a second razor cartridge (not shown). The cap 28 also preferably includes two retaining tabs 38A, 38B that are permanently attached to the cap by flexible hinges 40A, 40B. Each retaining tab 38A, 38B is movable between an open position shown in FIG. 1 and a closed position (FIG. 10A) that will be shown and described in more detail below. An upper end 23 of cap 28 preferably includes depressions 42A, 42B provided between the two sets of slots 34, 36. In turn, each retaining tab 38A, 38B includes a projection 44 that is sized to fit within the depressions 42A, 42B when the retaining tabs are in a dosed position. The frictional engagement between the projections 44 and the depressions 42 holds the retaining tabs in the dosed position so as to secure one or more razor cartridges within the razor cartridge receiving area 32.

The upper end 23 of cap 28 also preferably includes a plurality of apertures 46 that surround at least a portion of the perimeter of the razor cartridge receiving area 32. The cap may also include central apertures 48 provided within the razor cartridge receiving area 32. The peripheral apertures 46 surrounding the razor cartridge receiving area 32, and the central apertures 48 provided within the razor cartridge receiving area 32 are desirably in communication with an underside (not shown) of the cap. As will be described in more detail below, the apertures 46, 48 provide a path for a lubricating shaving preparation to be dispensed within and around the razor cartridge receiving area 32. As a result, the shaving preparation may be provided about the razor cartridges during a shaving operation.

Figure 2:
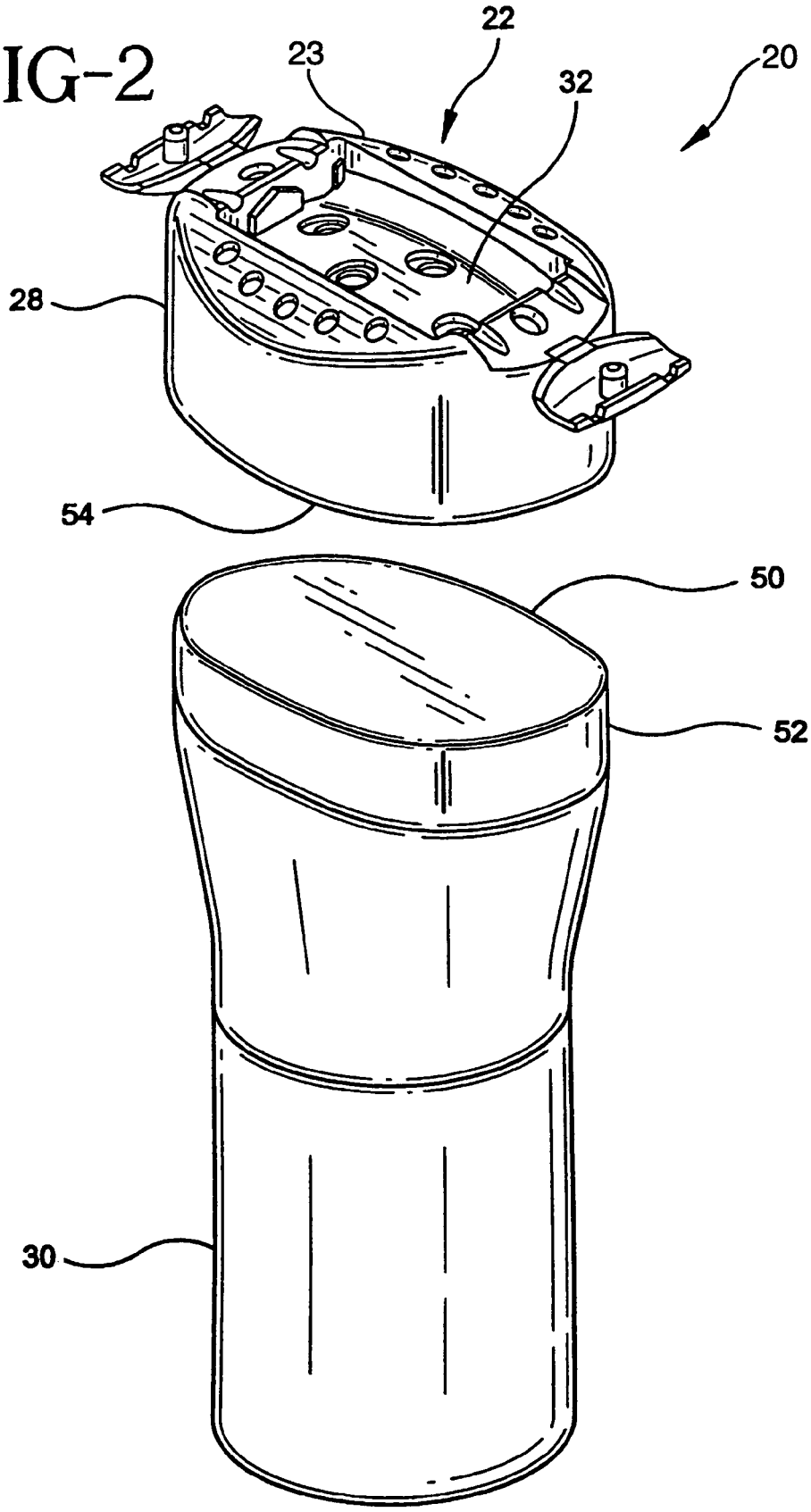
FIG. 2 shows the shaving assembly of FIG. 1 with the cap disassembled from the dispenser portion.

FIG. 2 shows cap 28 detached from an upper end 50 of dispenser portion 30. The outer perimeter 52 of the upper end 50 of dispenser portion 30 is preferably sized and shaped for closely engaging the inner surface of cap 28, adjacent the lower end 54 of cap 28. In certain preferred embodiments, one or more razor cartridges may be permanently attached to the upper end 23 of cap 28, and when the cutting blades of the razor cartridges are dull or worn, the cap 28 may be detached from dispenser 30 and replaced with a new cap having fresh razor cartridges. In other embodiments, the dispenser portion 30 of the shaving assembly 20 may be disposable. In these embodiments, the dispenser portion 30 may be disposed when all of the lubricating shaving preparation provided in the reservoir of the dispenser 30 has been dispensed. Thus, either the cap, the dispenser portion 30, or both the cap and the dispenser may be disposable. The razor cartridges (not shown) secured to the razor cartridge receiving area 32 may also be disposable.

Figure 3:
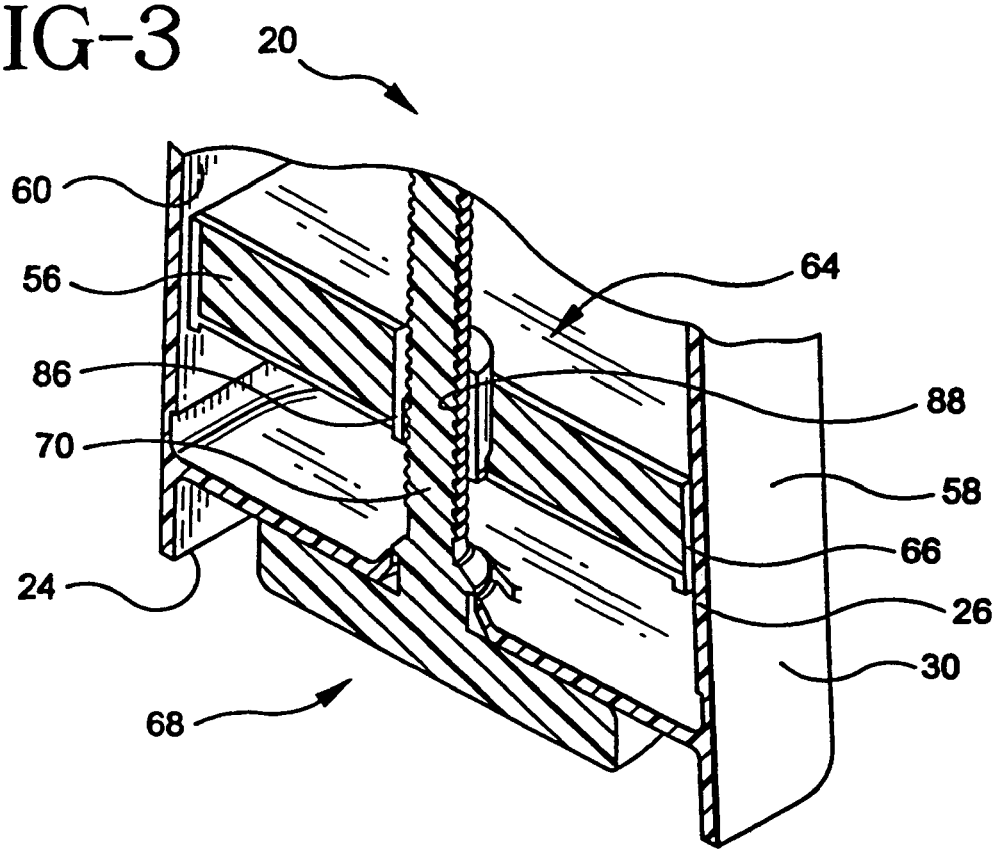
FIG. 3 shows a fragmentary cross-sectional view of the dispenser portion of the shaving assembly of FIG. 1 including a movable pedestal for dispensing a shaving preparation.
Figure 4:
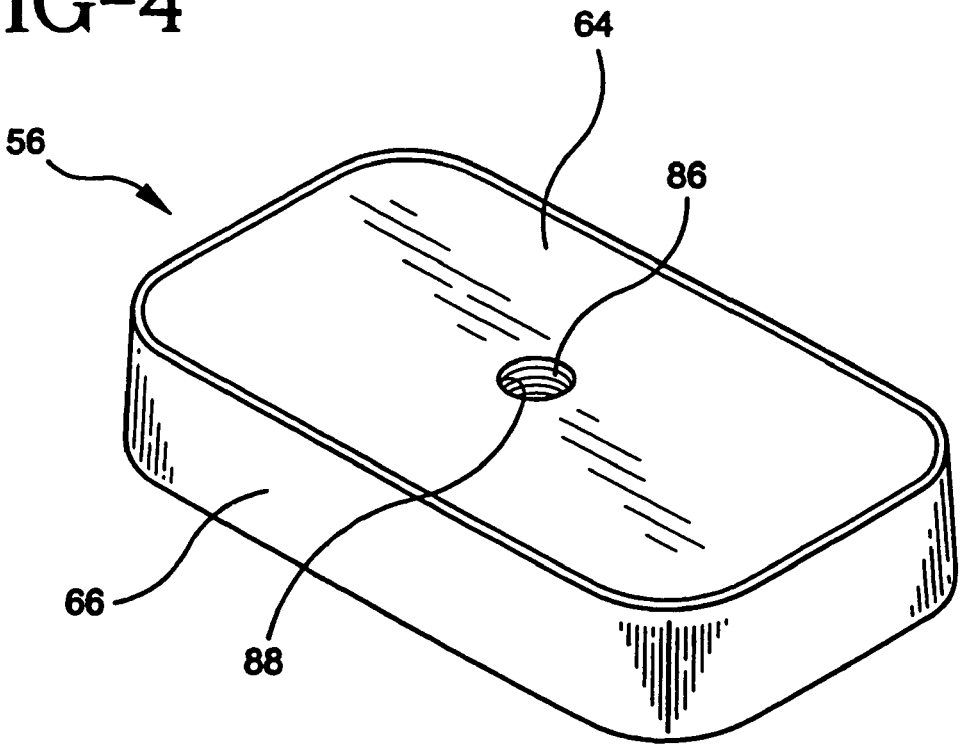
FIG. 4 shows a perspective view of the movable pedestal shown in FIG. 3.

FIGS. 3 and 4 show a movable platform or pedestal 56 that is provided within the interior portion of the dispenser portion 30 of the assembly. Referring to FIG. 3, dispenser portion 30 includes sidewalls 26 extending from the lower end 24 of assembly 20 toward the upper end 22 thereof. The sidewalls 26 have an exterior surface 58 and an interior surface 60. Shaving assembly 20 includes a reservoir for a mass of a shaving preparation. The reservoir 62 is defined by the upper surface 64 of pedestal 56, interior surface 60 of sidewalls 26 and an underside (not shown) of cap 28. A lubricating shaving preparation such as a jell, cream, lotion, oil or skin softener is preferably disposed within the reservoir 62. The outer perimeter 66 of pedestal 64 is preferably sized and shaped to form a fluid-tight seal with the interior surface 60 of sidewalls 26 so that the shaving preparation may not pass between the outer perimeter 66 of pedestal 56 and interior surface 60 of sidewalls 26.

Figure 5B:
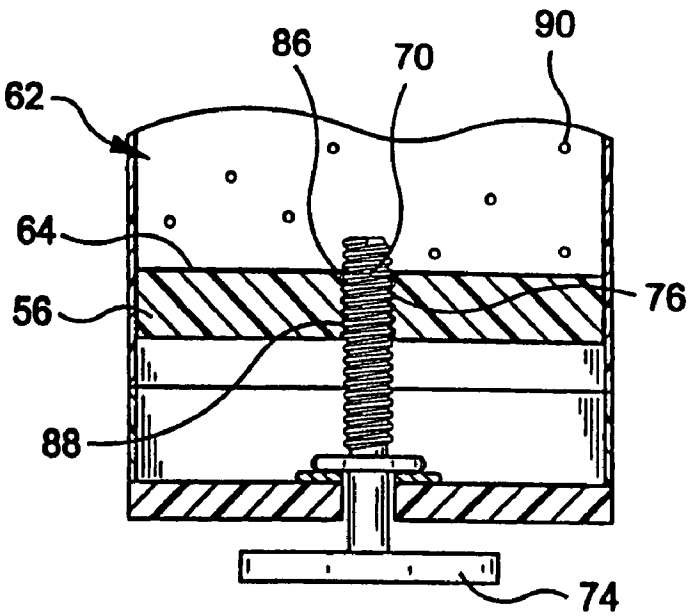
FIG. 5B shows the dispenser portion of the shaving assembly of FIG. 5A with the pedestal in a second position.
Figure 5A:
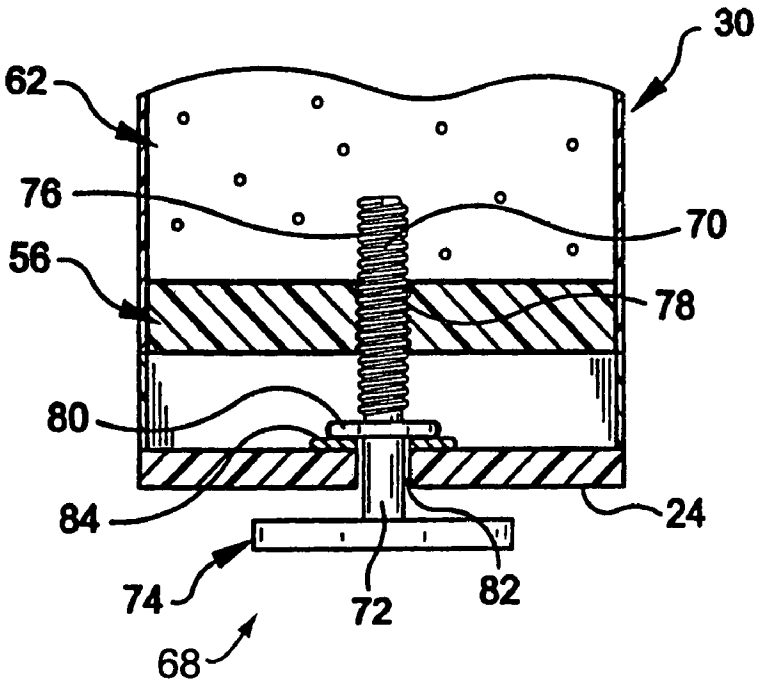
FIG. 5A shows the dispenser portion of the shaving assembly of FIG. 3 with the pedestal in a first position.

Referring to FIGS. 5A and 5B, shaving assembly 20 preferably includes an adjustable element 68 in contact with both the lower end 24 of dispenser 30 and movable platform 56. Adjustable element 68 preferably includes a shaft 70 having a lower end 72 connected to a knob 74 and an upper end 76 remote therefrom. The shaft 70 may include external threads 78 extending between the lower end 72 and upper end 76 thereof. The shaft 70 also preferably includes an annular flange 80 having an outer diameter greater than the outer diameter of threads 78. The flange 80 is located between the lower end 72 of shaft 70 and the external threads 78.

Referring to FIG. 5A, the adjustable element 68 is assembled with the lower end 24 of dispenser 30 by passing the threaded portion 78 of shaft 70 through an opening 82 at the lower end 24 of dispenser 30. The opening 82 is sized so that the external threads 78 of shaft 70 may pass easily therethrough. The opening 82 preferably includes tabs 84 extending toward the center of opening 82. The tabs 84 cooperatively define an inner diameter that is less than the diameter of annular flange 80. As a result, the flange 80 may be captured within the hollow space of the dispenser portion 30 of the assembly for rotatably securing adjustable element 68 to the lower end 24 of dispenser portion 30. However, the tabs 84 do not preferably allow the threaded shaft 70 to be withdrawn from the dispenser portion 30 without applying excessive force to the tabs 84.

Referring to FIGS. 5A and 5B, the knob 74 may be rotated for moving pedestal 56 toward the upper end 22 of assembly 20. Referring to FIGS. 3, 4, 5A and 5B, pedestal 56 includes a central opening 86 having internal threads 88 adapted to mesh with the external threads 78 of threaded shaft 70. As knob 74 is rotated, external threads 78 of shaft 70 engage internal threads 88 of central opening 86 so that the pedestal 56 moves in an upper direction toward the upper end 22 of shaving assembly 20. As a result, the top surface 64 of pedestal 56 engages shaving preparation 90 for urging the shaving preparation to pass through the apertures 46, 48 extending through cap 28. Each time a user of the shaving assembly 20 requires additional lubricant and/or shaving preparation, the knob 74 may be rotated for moving the pedestal toward the upper end of the assembly and dispensing additional shaving preparation.

Figure 6:
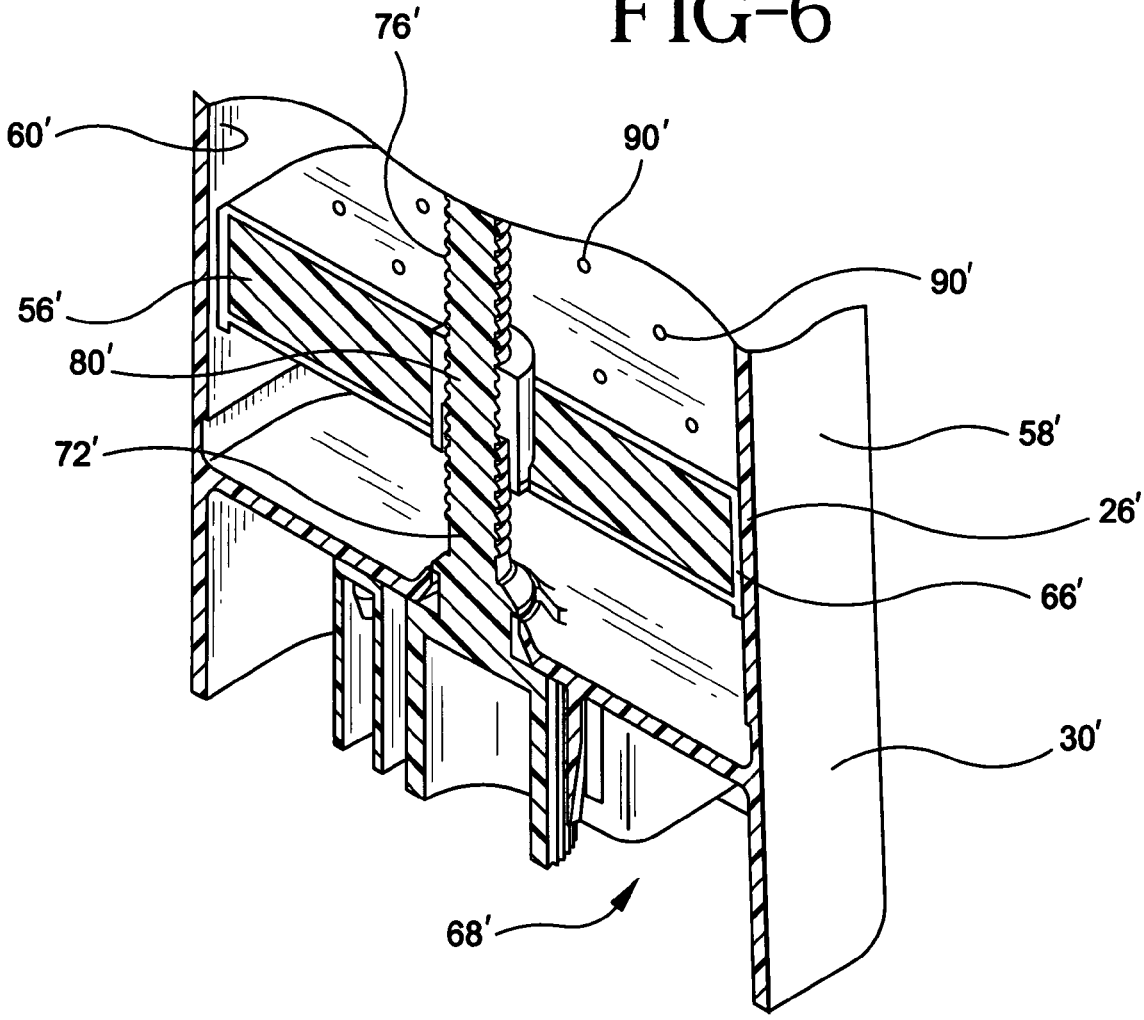
FIG. 6 shows a fragmentary cross-sectional view of a shaving assembly including a ratcheting mechanism, in accordance with further preferred embodiments of the present invention.
Figure 7:
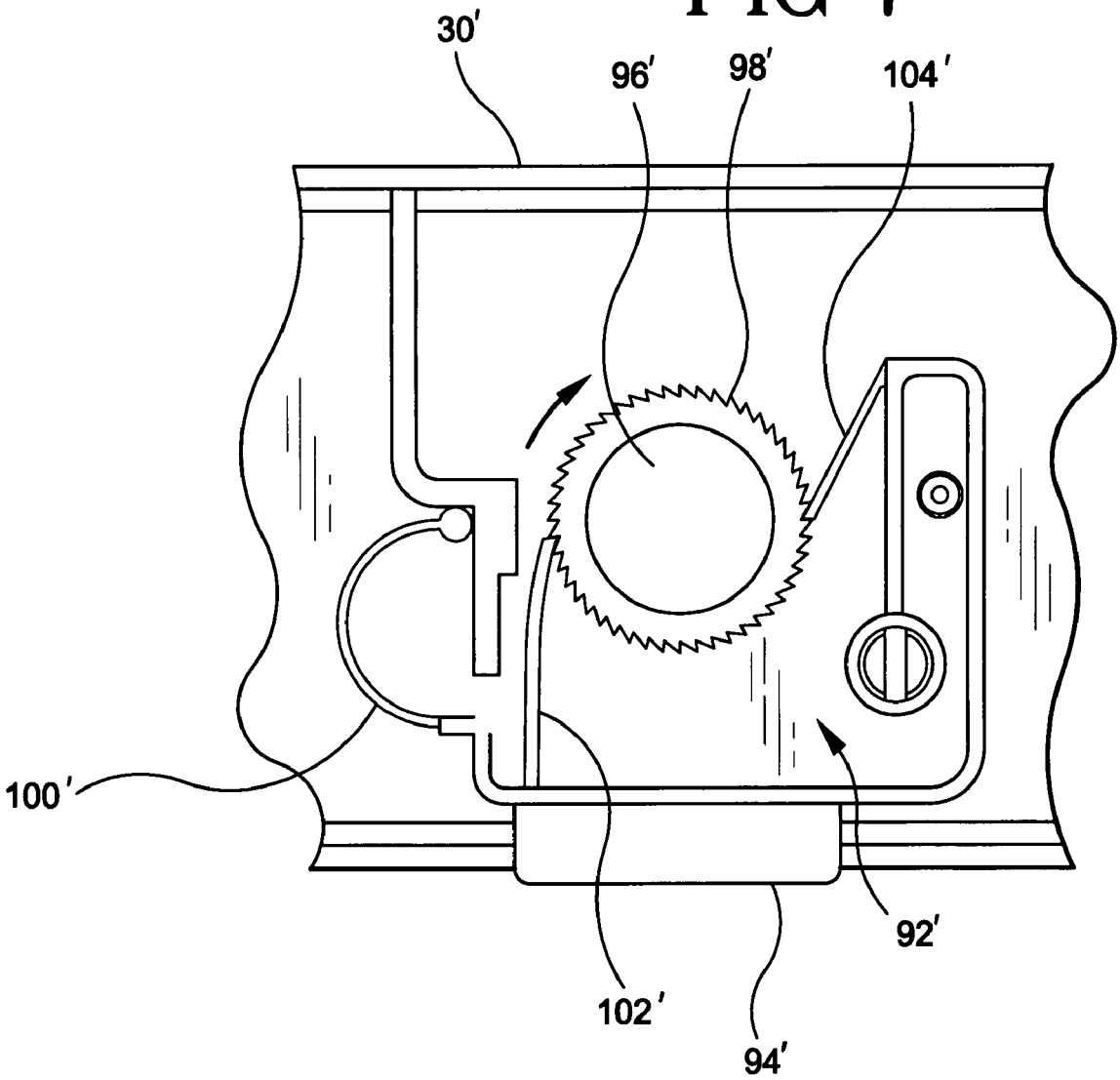
FIG. 7 shows a bottom end view of the ratcheting mechanism shown in FIG. 6.

FIGS. 6 and 7 show another embodiment of the present invention wherein the adjustable element 68' is substantially similar to that shown and described above; however, a ratcheting mechanism has replaced the rotatable knob 74 shown in FIGS. 3, 4, 5A and 5B. The assembly includes dispenser portion 30', having sidewalls 26' including exterior surface 58' and interior surface 60'. The outer perimeter 66' of pedestal 56' closely engages the interior surface 60' of sidewall 26'. The adjustable mechanism 68' includes shaft 80' having an upper end and a lower end 72' remote therefrom. Ratcheting mechanism 92' engages external threads 76' on shaft 80' for moving pedestal 56' in an upward direction. The ratcheting mechanism 92' preferably includes a depressible button 94' for incrementally urging the pedestal 56' in an upward direction.

FIG. 7 shows a bottom view of the ratcheting mechanism 68' shown in FIG. 6. The ratcheting mechanism includes a rotatable wheel 96' having teeth 98'. The depressible button 94' is connected to a spring 100' that returns the depressible button 94' to an undepressed or start position. The button 94' also includes a lever 102' connected thereto that engages the gear teeth 98' of ratchet wheel 96' to rotate the wheel when the button 94' is depressed. The ratcheting mechanism also includes an anti-rotating latch 104' that ensures that the wheel 96' is able to turn in only one direction. In operation, depressible button 94' is depressed for rotating wheel 96' which, in turn, rotates shaft 80' (FIG. 6) for moving the platform 56' in an upward direction so as to dispense shaving preparation 90' through the openings at the upper end of the assembly.

Figure 8:
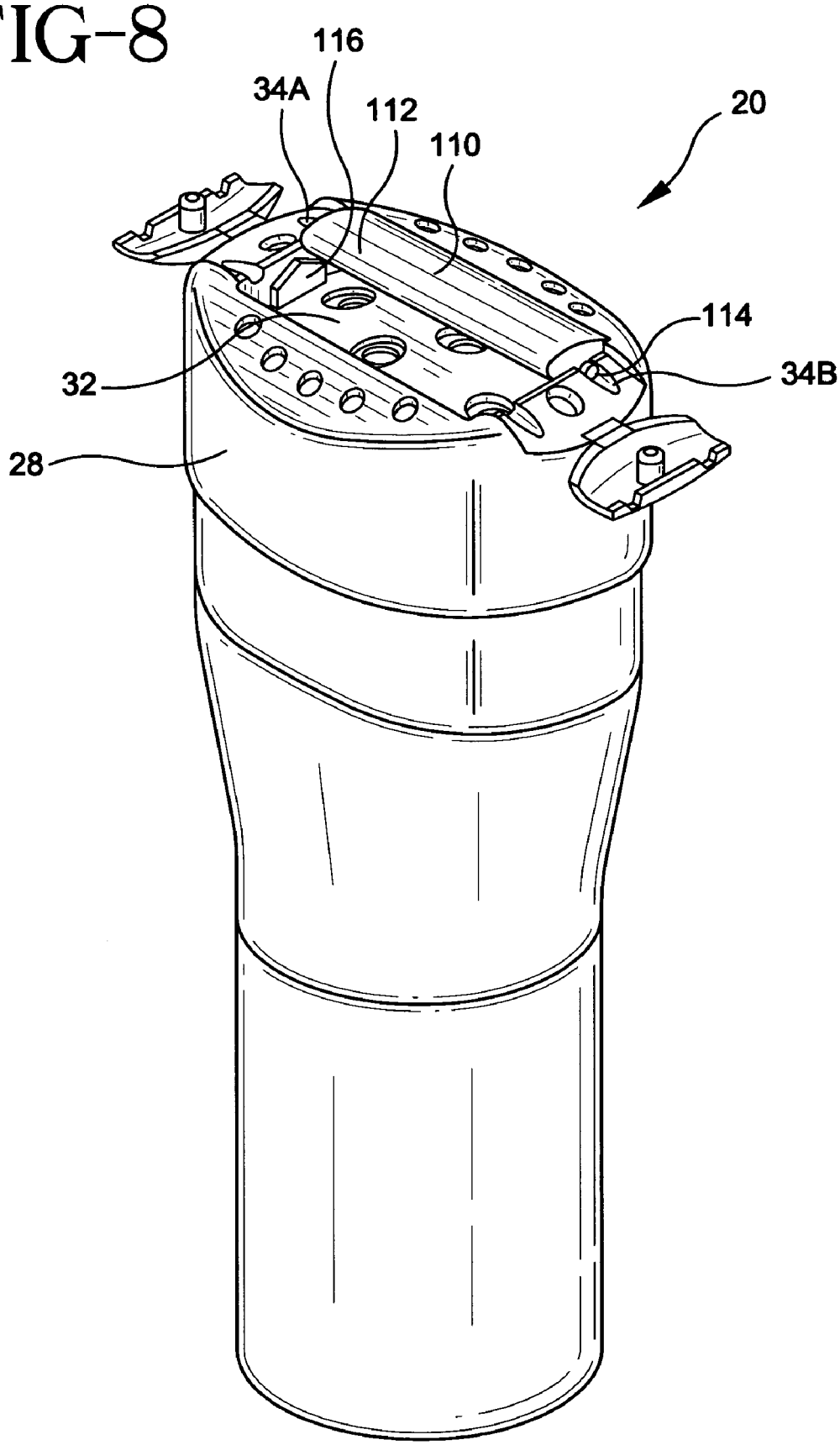
FIG. 8 shows a perspective view of the shaving assembly of FIG. 1 having one razor cartridge positioned within a cartridge receiving area, in accordance with certain preferred embodiments of the present invention.

FIG. 8 shows the shaving assembly 20 of FIG. 1 having a first cartridge 110 positioned within the razor cartridge receiving area 32. The first razor cartridge 110 includes one or more cutting blades 112 extending in directions substantially parallel to the longitudinal axis of the first razor cartridge 110. The ends of the first razor cartridge 110 include cylindrical-shaped rods or projections 114 that are sized and shaped to fit within the slots 34A, 34B formed in the top surface of cap 28 so that the razor cartridge 110 may pivot relative to the razor cartridge receiving area 32. The razor cartridge receiving area 32 also includes one or more bumpers 116 that are positioned for abutting against a portion of the first razor cartridge so as to limit the pivotal movement of the razor cartridge 110.

Figure 9:
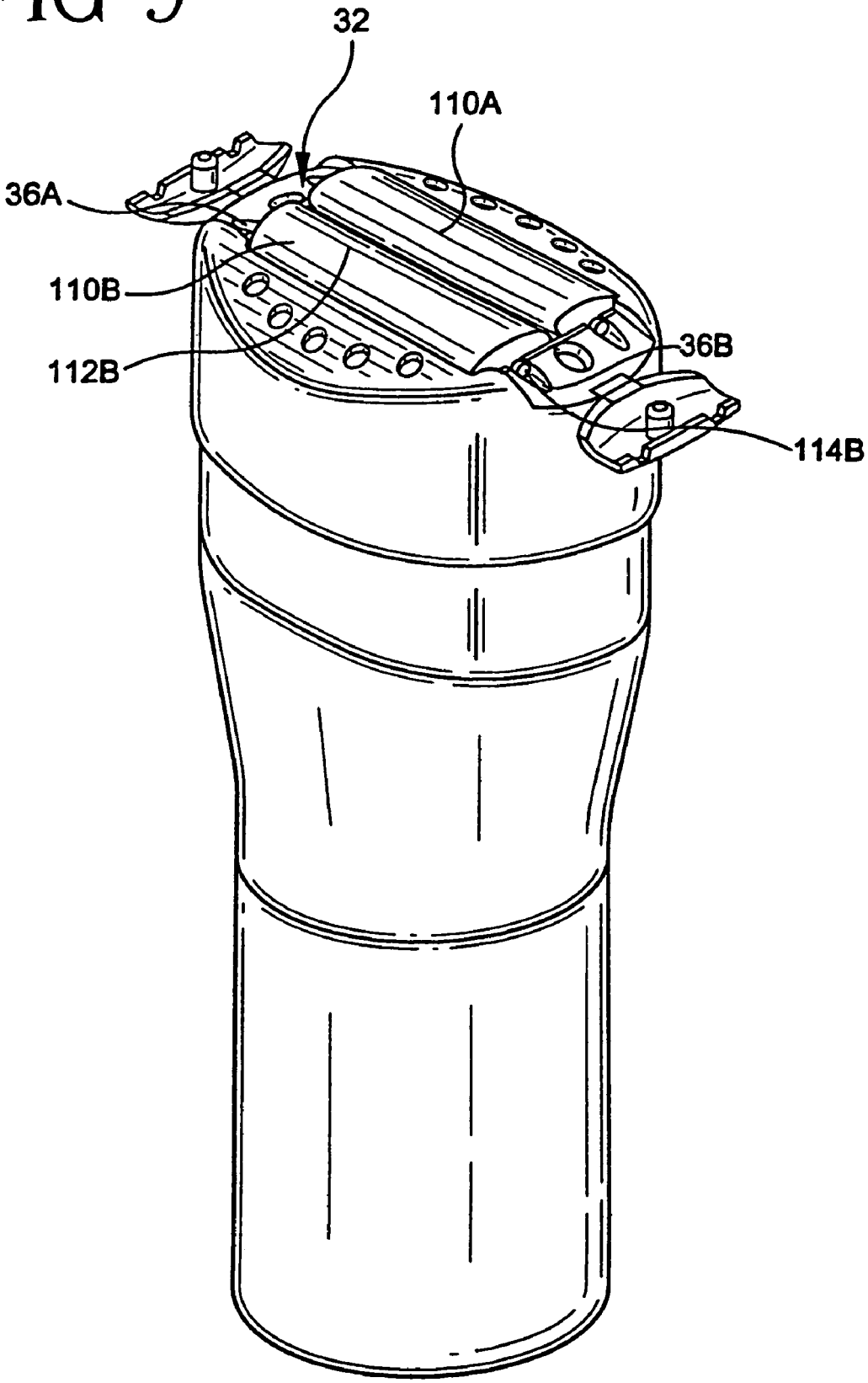
FIG. 9 shows the shaving assembly of FIG. 8 having a second razor cartridge positioned within the cartridge receiving area.

FIG. 9 shows the assembly of FIG. 8 with a second razor cartridge 110B positioned within razor cartridge receiving area 32. The second razor cartridge 110B includes one or more cutting blades 112B extending in directions that are substantially parallel to the longitudinal axis of second razor cartridge 110B. The ends of second razor cartridge 110B include cylindrical-shaped rods or projections 114B that are sized and shaped to fit within the second pair of slots 36A, 36B formed in the top surface cap. As with the first razor cartridge 110A, the cylindrical-shaped projections 114B of the second razor cartridge 110B are sized and shaped to allow the second razor cartridge to pivot within the razor cartridge receiving area 32.

Figure 10A:
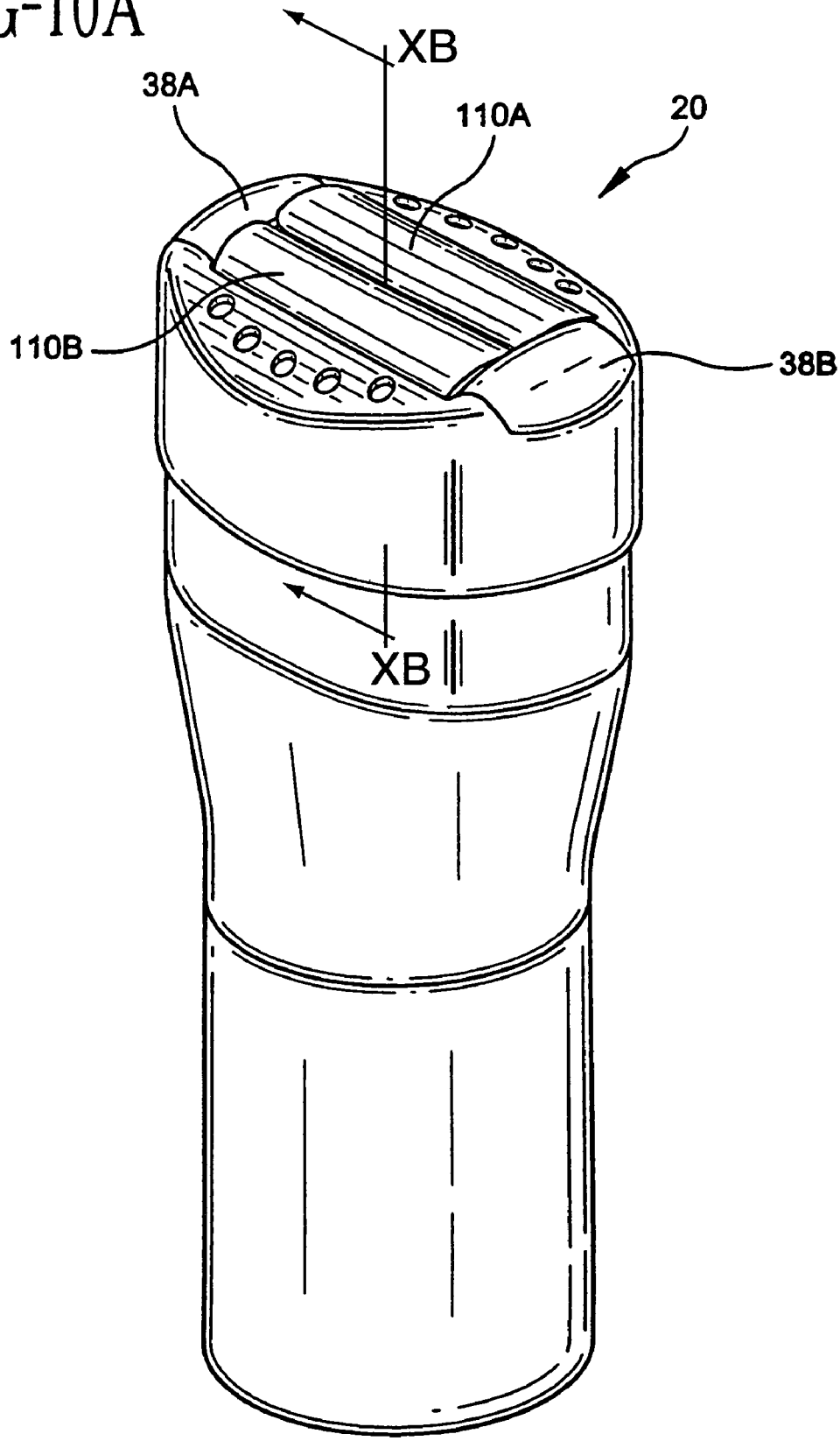
FIG. 10A shows a perspective view of the shaving assembly of FIG. 9 with two razor cartridges secured within the cartridge receiving area.

Referring to FIG. 10A, after the two razor cartridges 110A, 110B have been secured within the razor cartridge receiving area 32, the retaining tabs 38A, 38B are moved from the open position shown in FIG. 9 to the closed position shown in FIG. 10A. The retaining tabs 38A, 38B preferably secure the razor cartridges within the razor cartridge receiving area.

Figure 10B:
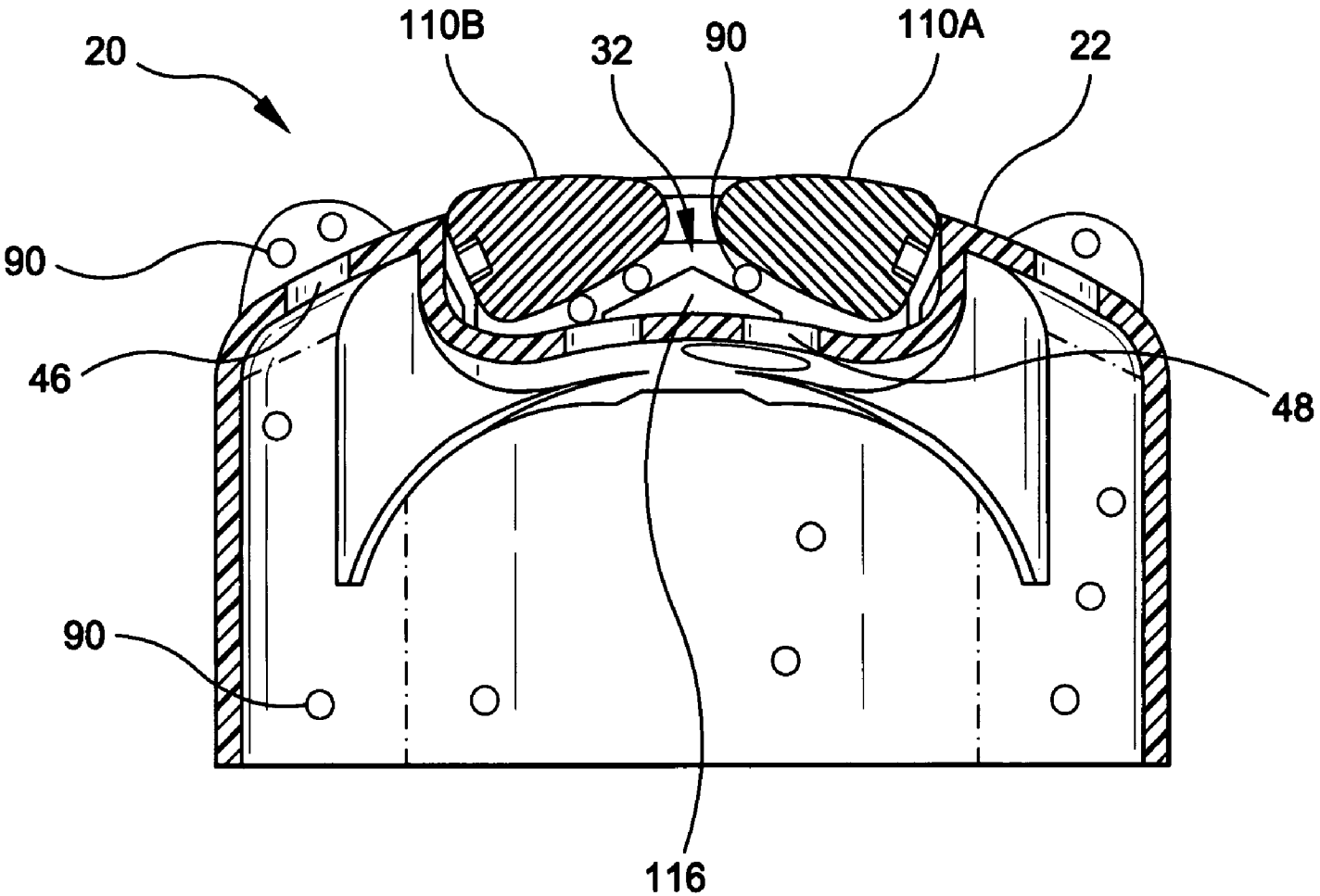
FIG. 10B shows a fragmentary cross-sectional view of FIG. 10A taken along lines XB—XB.

FIG. 10B shows a fragmentary cross-sectional view of the shaving assembly 20 with the razor cartridges 110A, 110B secured within razor cartridge receiving area 32. Although not specifically shown in FIG. 10B, the cutting blades of the razor cartridges 110A, 110B preferably confront one another. In other words, the cutting blades face toward the center of the razor cartridge receiving area 32. The first and second razor cartridges are free to pivot, with downward pivotal movement limited by a bumper 116.

When the movable pedestal (FIGS. 3 and 6) is moved toward the upper end 22 of the shaving assembly 20, the fluid shaving preparation 90 is dispensed through the peripheral apertures 46, as well as the central apertures 48 within the razor cartridge receiving area 32. As a result, the shaving preparation 90 is provided around the first and second razor cartridges 110A, 110B. Thus, an individual using the shaving assembly 20 will be able to simultaneously apply the fluid shaving preparation 90 immediately prior to shaving the shaving surface with the cutting blades of the first and second razor cartridges 110A, 110B. When the shaving preparation is washed away, the supply of shaving preparation may be replenished by actuating the adjustable element 68, 68' to dispense additional shaving preparation. The shaving assembly 20 may shave in any direction because the peripheral apertures 46 and central apertures 48 dispense shaving preparation completely around the perimeter of the razor cartridges 110A, 110B.

Figure 11A:
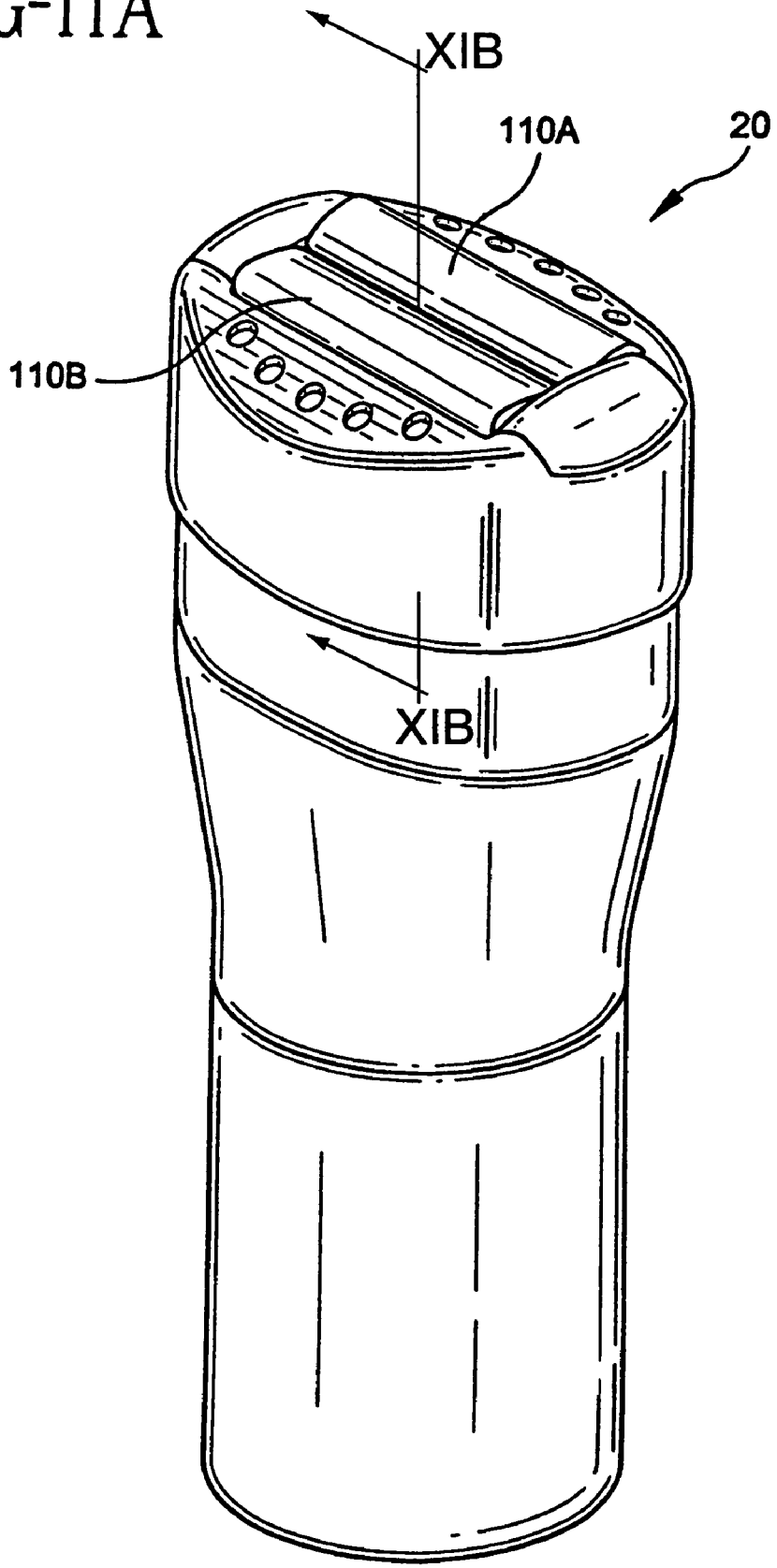
FIG. 11A shows a perspective view of the shaving assembly of FIG. 10A with razor cartridges positioned at a first pivotal position.
Figure 11B:
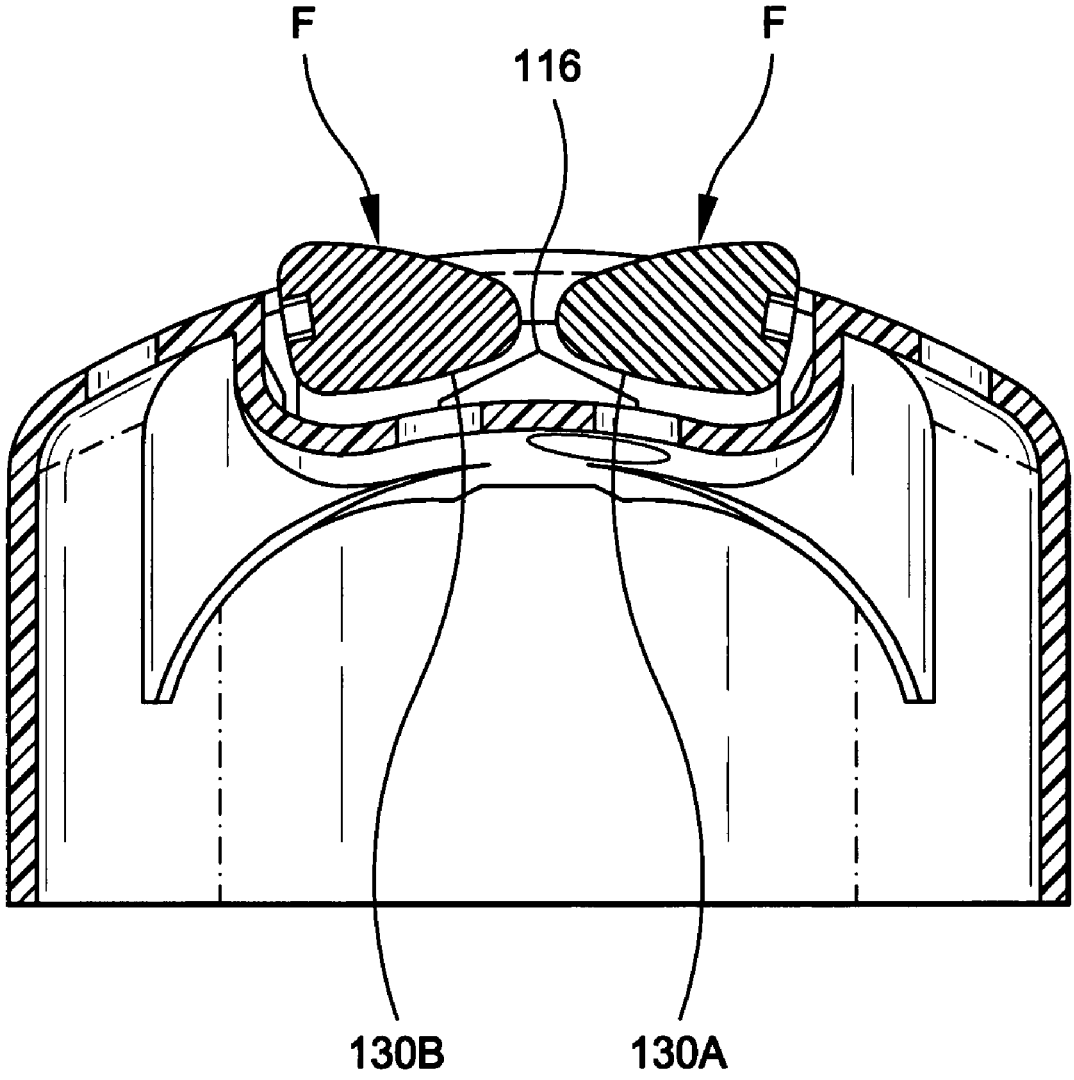
FIG. 11B shows a cross-sectional view of FIG. 11A taken along line XIB—XIB.

FIGS. 11A and 11B show respective perspective and cross-sectional views of the shaving assembly with the first and second razor cartridges 110A, 110B partially pivoted in a downward direction. The pivoting movement may be caused by a force F exerted on the razor cartridges. The first and second razor cartridges may continued to pivot until the undersides 130A, 130B of the respective razor cartridges abut against an upper surface of bumper 116.

Figure 12A:
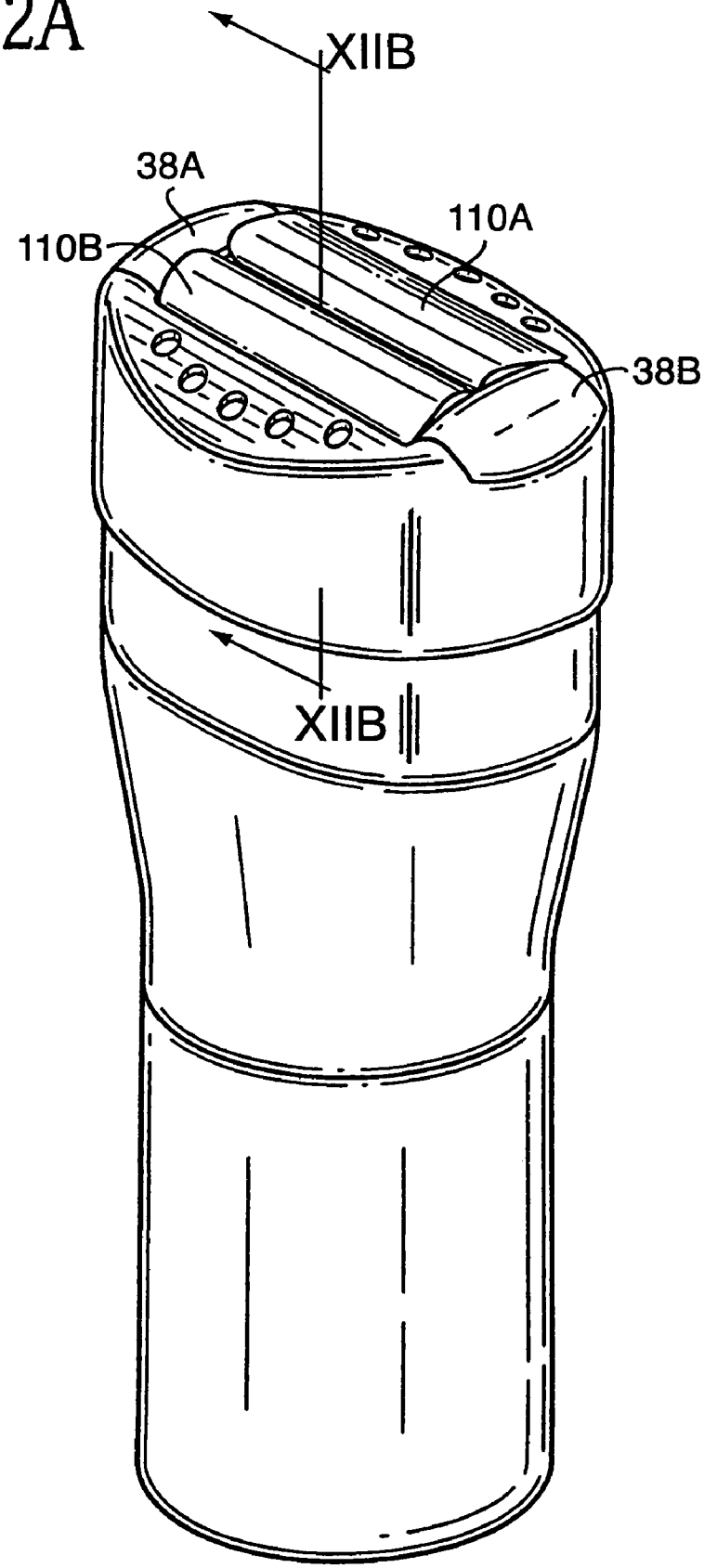
FIG. 12A shows a perspective view of the shaving assembly of FIG. 11A with the razor cartridges positioned in a second pivotal position.
Figure 12B:
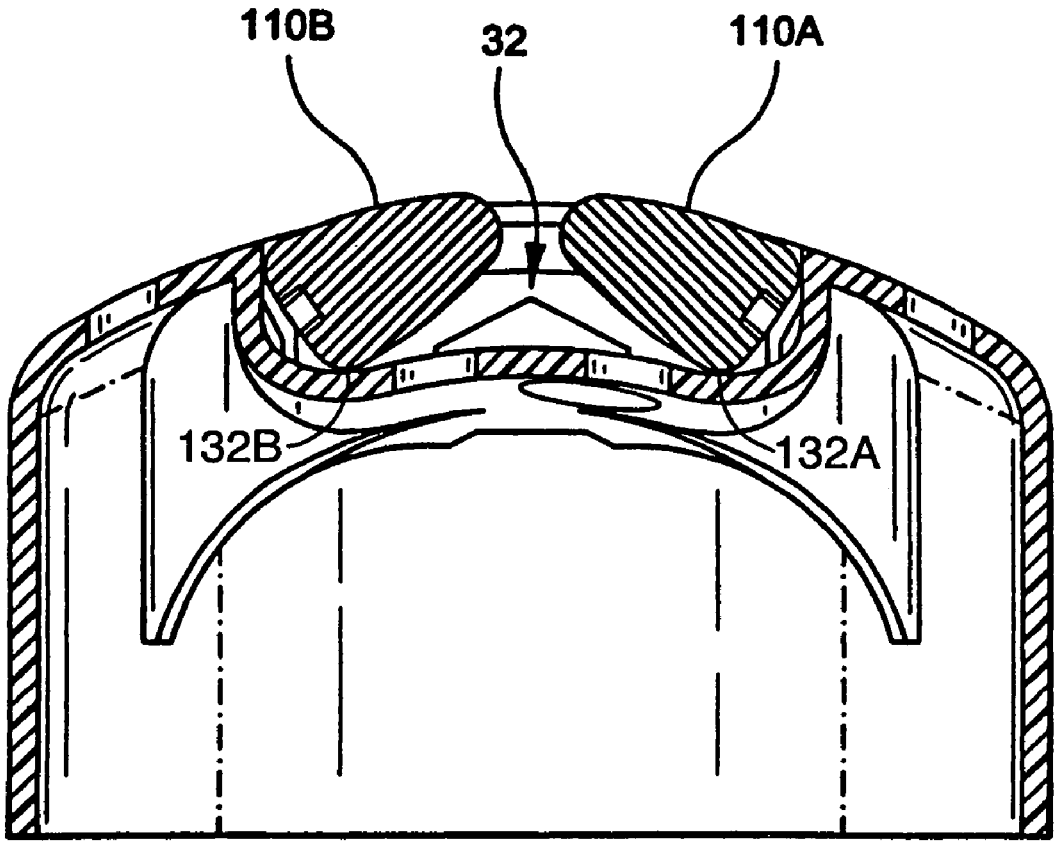
FIG. 12B shows a cross-sectional view of FIG. 12A taken along XIIB—XIIB.

FIGS. 12A and 12B show respective perspective and cross-sectional views of the shaving assembly 20 with first and second razor cartridges 110A, 110B pivoted in an upward direction. Upward pivotal movement of the first and second razor cartridges 110A, 110B is limited by a rear underside surface 132A, 132B of the respective razor cartridges abutting against the bottom of the razor cartridges receiving area 32.

Although the present invention has been described with reference to particular preferred embodiments, it is to be understood that the embodiments are merely illustrative of the principles and application of the present invention. It is therefore to be understood that numerous modifications may be made to the preferred embodiments and that other arrangements may be devised without departing from the spirit and scope of the present invention as defined by the claims.

What is claimed is:

1. A lubricating shaving assembly, comprising:

a grippable body having an upper end, a lower end, and one or more side walls extending between the upper and lower ends, said body including a storage reservoir for holding a shaving preparation, said storage reservoir being substantially enclosed by the upper and lower ends and the one or more side walls of said body;

the upper end of said body having a razor cartridge receiving area and having a first razor cartridge and a second razor cartridge, each of the first and second razor cartridges including at least one razor blade, attached to the receiving area such that the at least one razor blade of the two razor cartridges confront one another, the upper end of said body further including a plurality of openings adjacent to and at least partially surrounding the razor cartridge receiving area, said openings being positioned such that when the first and second razor cartridges are located in said razor cartridge receiving area, said plurality of openings at least partially surround said razor blades defined by said razor cartridges, and wherein said openings are in communication with said storage reservoir; and a pedestal disposed within said storage reservoir of said body, wherein said pedestal is selectively movable between the lower and upper ends of said body for dispensing fluid shaving preparation through said plurality of openings at the upper end of said body;

wherein both of the first and second cartridges are positioned within the cartridge receiving area such that both are pivotable relative to the cartridge receiving area and such that the at least one blade of the first cartridge and the at least one blade of the second cartridge confront one other, whereby the first cartridge is operable to shave in a first direction, and the second cartridge is operable to shave in a second, generally opposite, direction.

2. The shaving assembly as claimed in claim 1, wherein said shaving preparation is selected from the group consisting of fluid shaving preparations, semisolid shaving preparations and gels.

3. The shaving assembly as claimed in claim 1, further including one or more plurality of openings at the upper end of said body disposed within said razor cartridge receiving area.

4. The shaving assembly as claimed in claim 1, wherein said pedestal includes a top surface engagable with said fluid shaving preparation, and wherein movement of said pedestal toward the upper end of said body urges the fluid shaving preparation to pass through the plurality of openings at the upper end of said body.

5. The shaving assembly as claimed in claim 4, wherein said body has a cap and a lower body portion.

6. The shaving assembly as claimed in claim 5, wherein the cap comprises the upper end of said body, and the lower body portion includes the lower end of said body and the reservoir of said body.

7. The shaving assembly as claimed in claim 6, wherein the cap is detachably secured to the lower body portion.

8. The shaving assembly as claimed in claim 6, wherein one or more razor cartridges are permanently secured to the cap of said body.

9. A shaving assembly, comprising:

a handle having an upper end, a lower end and a substantially enclosed storage reservoir between the upper and lower ends, said storage reservoir for holding a fluid shaving preparation;

the upper end of said handle having a razor cartridge receiving area and having a first razor cartridge and a second razor cartridge, each of said first and second razor cartridges including at least one razor blade, attached thereto such that the at least one razor blade of the first razor cartridge confronts the at least one blade of the second razor cartridge, the upper end of said handle further including a plurality of openings adjacent to and at least partially surrounding the razor cartridge receiving area, said openings being positioned such that when the first and second razor cartridges are located in said razor cartridge receiving area, said plurality of openings at least partially surround said razor blades defined by said razor cartridges, and wherein said openings are in communication with said storage reservoir; and a pedestal disposed within said storage reservoir and movable toward the upper end of said handle for urging the fluid shaving preparation through said plurality of openings;

wherein both of the first and second cartridges are positioned within the cartridge receiving area such that both are pivotable relative to the cartridge receiving area and such that the at least one blade of the first cartridge and the at least one blade of the second cartridge confront one other, whereby the first cartridge is operable to shave in a first direction, and the second cartridge is operable to shave in a second, generally opposite, direction.

10. The shaving assembly as claimed in claim 9, further including one or more plurality of openings disposed within the razor cartridge receiving area at the upper end of said handle.

11. The shaving assembly as claimed in claim 9, wherein said pedestal includes a top surface engagable with said fluid shaving preparation, and wherein movement of said pedestal toward the upper end of said handle urges the fluid shaving preparation to pass through the plurality of openings disposed within the razor cartridge receiving area at the upper end of said handle.

12. A lubricating shaving assembly, comprising:

a dispenser having an upper end, a lower end, and side walls extending between the upper and lower ends, said dispenser including a storage reservoir for holding a fluid shaving preparation;

a cap removably secured to the upper end of said dispenser, wherein said storage reservoir is surrounded by the lower end and side walls of said dispenser and by said cap;

an upper end of said cap having a razor cartridge receiving area and having a first razor cartridge and a second razor cartridge, each of said razor cartridges including at least one razor blade, the first and second razor cartridges being secured within the receiving area such that the at least one razor blade of the first razor cartridge confronts the at least one razor blade of the second razor cartridge, the upper end of said cap further including a plurality of apertures adjacent to and at least partially surrounding the razor cartridge receiving area, said apertures being positioned such that when the first and second razor cartridges are located in said razor cartridge receiving area, said plurality of apertures at least partially surround said razor blades defined by said razor cartridges, and wherein said apertures are in communication with said storage reservoir; and a pedestal disposed within said storage reservoir of said dispenser, wherein said pedestal is selectively movable toward said cap for dispensing fluid shaving preparation through said plurality of apertures at the upper end of said cap;

wherein both of the first and second cartridges are positioned within the cartridge receiving area such that both are pivotable relative to the cartridge receiving area and such that the at least one blade of the first cartridge and the at least one blade of the second cartridge confront one other, whereby the first cartridge is operable to shave in a first direction, and the second cartridge is operable to shave in a second, generally opposite, direction.

13. The shaving assembly as claimed in claim 12, further including at least one aperture at the upper end of said cap within the razor cartridge receiving area underlying the one or more razor cartridges secured within the razor cartridge receiving area for allowing said fluid shaving preparation to flow around said razor cartridges.

14. The shaving assembly as claimed in claim 12, wherein the razor cartridge receiving area includes one or more apertures at the upper end of said cap.

* * * * *